US009022042B1

(12) United States Patent
Fichtl

(10) Patent No.: US 9,022,042 B1
(45) Date of Patent: May 5, 2015

(54) MASCARA WITH LIPSTICK, CONCEALER, AD-HOC USER MIXABLE BLUSH, AND GLITTER COMPONENT

(71) Applicant: Sharalyn Fichtl, McKinney, TX (US)

(72) Inventor: Sharalyn Fichtl, McKinney, TX (US)

( * ) Notice: Subject to any disclaimer, the term of this patent is extended or adjusted under 35 U.S.C. 154(b) by 0 days.

(21) Appl. No.: 14/182,220

(22) Filed: Feb. 17, 2014

(51) Int. Cl.

| | |
|---|---|
| ***A45D 40/24*** | (2006.01) |
| ***A45D 40/26*** | (2006.01) |
| *A45D 40/18* | (2006.01) |
| *A45D 40/20* | (2006.01) |

(52) U.S. Cl.
CPC ..... *A45D 40/24* (2013.01); *A45D 40/262* (2013.01); *A45D 40/18* (2013.01); *A45D 40/20* (2013.01)

(58) Field of Classification Search
CPC ..... A43K 27/02; A43K 27/08; A45D 40/20; A45D 40/01; A45D 40/04; A45D 40/24; A45D 40/26; A45D 33/28; A45D 33/0068; A47L 13/30; A47L 13/12
USPC ..... 132/218, 317, 318, 297; 401/17–19, 401/126
See application file for complete search history.

(56) References Cited

U.S. PATENT DOCUMENTS

| | | | | |
|---|---|---|---|---|
| 1,576,567 | A | 3/1926 | Buhl-Bonanno | |
| 2,344,883 | A * | 3/1944 | Kairalla | 401/11 |
| 3,192,933 | A | 7/1965 | Prince | |
| 3,201,314 | A * | 8/1965 | Morshauser et al. | 424/64 |
| 3,479,429 | A * | 11/1969 | Biamonte et al. | 424/63 |
| 4,291,018 | A | 9/1981 | Oeda et al. | |
| 4,743,443 | A * | 5/1988 | Pisani et al. | 424/63 |
| 4,756,906 | A | 7/1988 | Sweeny | |
| 4,996,044 | A | 2/1991 | Mercado et al. | |
| 5,053,220 | A | 10/1991 | Arraudeau | |
| 5,509,742 | A * | 4/1996 | Balzarini | 401/17 |
| 6,555,509 | B2 * | 4/2003 | Abbas et al. | 510/143 |
| 6,695,510 | B1 | 2/2004 | Look et al. | |
| 8,523,470 | B2 | 9/2013 | Palo et al. | |
| 2002/0014253 | A1 * | 2/2002 | Bengis | 132/297 |
| 2003/0041870 | A1 * | 3/2003 | Su et al. | 132/297 |
| 2003/0053839 | A1 * | 3/2003 | Dumler et al. | 401/17 |
| 2003/0152410 | A1 * | 8/2003 | Huang | 401/19 |
| 2005/0019084 | A1 * | 1/2005 | Gueret | 401/25 |
| 2008/0268003 | A1 * | 10/2008 | Thevenet | 424/401 |

FOREIGN PATENT DOCUMENTS

| | | | |
|---|---|---|---|
| EP | 1712487 | A1 * | 10/2006 |
| WO | WO2008038226 | | 4/2008 |
| WO | WO 2008064493 | A1 * | 6/2008 |

* cited by examiner

*Primary Examiner* — Robyn Doan
(74) *Attorney, Agent, or Firm* — William Lovin & Assoc., LLC

(57) ABSTRACT

The present invention relates generally to a system for easily carrying mascara and multiple other cosmetic products to be applied to the face and in particular to a unitary stick system for easily carrying a mascara and three other cosmetic products for application to the face wherein the user may mix more than one of these other cosmetic products during application to create an aesthetically different cosmetic product.

9 Claims, 4 Drawing Sheets

MASCARA WITH LIPSTICK, CONCEALER, AD-HOC USER MIXABLE BLUSH, AND GLITTER COMPONENT

CROSS-REFERENCE TO RELATED APPLICATIONS

Not applicable.

FIELD OF THE INVENTION

The present invention relates generally to a system for easily carrying mascara and multiple other cosmetic products to be applied to the face and in particular to a unitary stick system for easily carrying a mascara and at three other cosmetic products for application to the face wherein the user may mix more than one of these other cosmetic products during application to create an aesthetically different cosmetic product.

BACKGROUND OF THE INVENTION

Mascara, lipstick, concealer, and blush are the essential four cosmetic products for many women. These products often need re-application or "touching up" in use, and are thus routinely carried. Ordinarily, these are separate products in separate containers with separate modes of application. Lipstick is usually carried and applied in the traditional way. Concealers too are widely available in stick form, whereas mascara is usually dispensed in a hollow tube and applied by means of a supplied conical or cylindrical brush. Blush is ordinarily supplied in a solid cake and applied by means of a separate open brush. Also, the practice of using lipstick to fashion an impromptu blush has been practiced for many years.

Complicating the matter further, lipstick, blush, and concealer are readily available today with admixed mica or fine polyester glitter to form variants that have sheen or sparkle varying from subtle to pronounced.

Thus, an individual who from time to time chooses to wear a particular color of lipstick, both with and without glitter, concealer with and without glitter, and blush with and without glitter thus faces a dilemma in that they must carry six different products for each range of colors that they choose. Including a mascara, this totals seven. This is bulky and unwieldy.

Further, if an individual sometimes wears lipstick or blush in different shades of the same color, say salmon pink, one day and a lighter or darker version of the same color on a different day, different colors of both lipstick and blush are needed.

Numerous examples exist in the prior art that seek to solve some of these problems but none solves them all. For example, U.S. Pat. No. 1,576,567 discloses a longitudinally sectioned lipstick comprising colorant and cold-cream to be applied together to the lips. U.S. Pat. No. 3,192,933 discloses a dual color lipstick with concentric layers of lipstick so designed to be used as a lipstick with integral lip liner. U.S. Pat. No. 4,291,018 discloses another type of core-sheath lipstick featuring components with differing viscosities. U.S. Pat. No. 6,695,510 discloses "lip balm, deodorant, sunscreen, and glue stick" (column 1, line 9) with two products in the stick to make it more "aesthetically pleasing to increase use of such products" (column 1, line 26) and to ensure that users can "readily distinguish the two products from one another" (column 1, line 33). Indeed, in the public domain, such applicators are known that feature three different colors of lipstick. U.S. Pat. No. 8,523,470 discloses a specially shaped lipstick/gloss/liner applicator with a cross-section optimized to allow the user to simultaneously apply lipstick, liner, and gloss in a single, one per lip, operation. While mascara in combination with lipstick is well-known in the prior art, there is no unitary stick system in the prior art allowing the user to carry and apply mascara and lipstick, concealer, and blush (with or without glitter component).

Similarly, the prior art is devoid of any invention teaching the use of a stick cosmetic product comprising at least three different cosmetic substances (e.g. lipstick, concealer, and glitter) that are blended together ad-hoc by the user during the act of application to form a blush with or without glitter.

Similarly, the prior art is devoid of any invention teaching the use of a stick cosmetic product comprising at least three different cosmetic substances (e.g. lipstick, concealer, and glitter) that are blended together ad-hoc by the user during the act of application to form other mixtures of these substances achieving differing aesthetic traits (e.g. lipstick with glitter, lipstick without glitter, concealer with glitter, and concealer without glitter) and different hues (e.g. lipstick with concealer to form a lighter or darker hue of lipstick and blush).

Thus, It is a first goal of the present invention to provide a compact, handheld unitary stick comprising mascara with lipstick, concealer, ad-hoc user mixable blush, and glitter component.

It is a second goal of the present invention to provide this compact, handheld unitary stick comprising mascara with lipstick, concealer, ad-hoc user mixable blush, and glitter component such that the user may apply lipstick, concealer, or blush with or without admixed glitter.

It is a third goal of the present invention to provide this handheld unitary stick comprising mascara with lipstick, concealer, ad-hoc user mixable blush, and glitter component such that the user may create a variable hue lipstick, concealer, or blush with or without admixed glitter.

BRIEF DESCRIPTION OF THE INVENTION

A first exemplary embodiment of a mascara with lipstick, concealer, ad-hoc user mixable blush, and glitter component is comprised of a generally cylindrical, two-piece hollow housing disposed along a longitudinal axis with a substantially circular cross section. At one end, the hollow cavity is closed at it distal-most extent and contains mascara (the mascara portion). The balance of the cylindrical housing disposed at the other end (the stick portion) contains a lipstick, concealer, ad-hoc user-mixable blush, and glitter component stick (the stick cosmetic). The mascara portion is screwably or slidably affixable to the base of the stick portion such that a mascara applicator shaft and brush affixed to the base of the stick portion protrudes longitudinally into the open end of the mascara-filled hollow core of the mascara portion when the two portions are screwed or slid together.

The stick cosmetic is itself longitudinally sectioned into adjoined layers of lipstick, glitter component, and concealer such that the layer containing the glitter component is disposed between the other two. The stick cosmetic may be advanced from the cylindrical housing for use in the usual manner. Ordinarily, the cylindrical housing is covered by a close fitting substantially cylindrical cap to prevent the stick cosmetic from drying out or attracting dust.

The invention is used in the following manner: At any time, the user may unscrew the mascara portion and separate the mascara portion from the stick portion use the newly exposed mascara applicator brush to apply mascara to the eyelashes. When done, the user replaces the mascara brush into the mascara portion of the device and screws or slides the mascara portion and stick portions of the device together. To use the stick cosmetic, the user removes the cylindrical cap by screwing or unsliding it, advances the stick cosmetic to expose some portion of the three adjoined layers and performs at least one of the following actions:

To apply lipstick, the user aligns the lipstick layer such that some point on its longitudinally aligned mid-line laying on the outer surface of the lipstick layer is aligned tangentially with respect to the lip and applies lipstick to the lip in the usual manner by stroking the lipstick layer across the surface of the lip.

To apply concealer, the user aligns the concealer layer such that some point on its longitudinally aligned mid-line laying on the outer surface of the concealer layer is aligned tangentially with respect to the surface of the skin where the concealer is desired and applies concealer to the skin in the usual manner by stroking the concealer layer across the skin.

To apply blush, the user aligns the lipstick layer such that some point on its longitudinally aligned mid-line laying on the outer surface of the lipstick layer is aligned tangentially with respect to the surface of the skin where the blush is desired and applies lipstick to the skin by stroking the lipstick layer across the skin. The lipstick is then blended into the skin by the user.

To apply lipstick with glitter, the user aligns the stick cosmetic such that the some point on the longitudinally aligned interface between the lipstick layer and the glitter component layer along the outer surface of the stick cosmetic is aligned tangentially with respect to the lip and applies both lipstick and glitter component to the lip in the usual manner by stroking the interface between the two layers across the surface of the lip.

To apply concealer with glitter, the user aligns the stick cosmetic such that some point on the longitudinally aligned interface between the concealer layer and the glitter component layer along the outer surface of the stick cosmetic is aligned tangentially with respect to surface of the skin where the concealer with glitter is desired and applies both concealer and glitter component to the skin in the usual manner by stroking the interface between the two layers across the skin.

To apply blush with glitter, the user aligns the stick cosmetic such that some point on the longitudinally aligned interface between the lipstick layer and the glitter component layer along the outer surface of the stick cosmetic is aligned tangentially with respect to surface of the skin where the lipstick and glitter component is desired and applies both the lipstick and glitter component to the skin in the usual manner by stroking the interface between the two layers across the skin. The lipstick and glitter component are then blended into the skin by the user.

To apply lipstick, concealer, and glitter as a variable hue lipstick with glitter, the user aligns the stick cosmetic such that some point on the longitudinally aligned mid-line between the lipstick layer and the concealer layer lying in the glitter component layer along the outer surface of the stick cosmetic is aligned tangentially with respect to the surface of the lip where the lipstick, concealer, and glitter components are applied simultaneously to the lip by stroking all three layers across the lip.

To apply lipstick, concealer, and glitter as a variable hue blush with glitter, the user aligns the stick cosmetic such that some point on the longitudinally aligned mid-line between the lipstick layer and the concealer layer lying in the glitter component layer along the outer surface of the stick cosmetic is aligned tangentially with respect to the surface of the skin where the lipstick, concealer, and glitter component are desired and applies the lipstick, concealer, and glitter components simultaneously to the skin by stroking all three layers across the skin. The lipstick, concealer, and glitter component are then blended into the skin by the user.

While variable hue lipstick and blush may be applied using the first exemplary embodiment via a multi-step operation (i.e. apply lipstick, then concealer, then manually blend), a second exemplary embodiment of a mascara with lipstick, concealer, ad-hoc user mixable blush, and glitter component is constructed as described above, with the exception that the stick cosmetic is longitudinally sectioned into adjoined layers of lipstick, glitter component, and concealer such that the layer containing the glitter component is only partially disposed between the other two. This has the advantage of providing one side of the stick cosmetic where the lipstick and concealer layers are juxtaposed next to each other without the glitter component layer interposed between. This provides an optimized system for applying variable hue lipstick and blush without glitter. Specifically:

To apply lipstick in a user definable hue, the user aligns the stick cosmetic such that the longitudinally aligned interface between the lipstick layer and the concealer layer along the outer surface of the stick cosmetic is aligned tangentially with respect to the lip and applies both lipstick and concealer to the lip by stroking the interface between the two layers across the surface of the lip.

To apply blush in a user definable hue, the user aligns the stick cosmetic such that the longitudinally aligned interface between the lipstick layer and the concealer layer along the outer surface of the stick cosmetic is aligned tangentially with respect to the skin where blush is desired and applies both lipstick and concealer to the skin by stroking the interface between the two layers across the surface of the skin. The lipstick and concealer are then blended into the skin by the user.

DETAILED DESCRIPTION OF THE EMBODIMENTS

Figure 1:
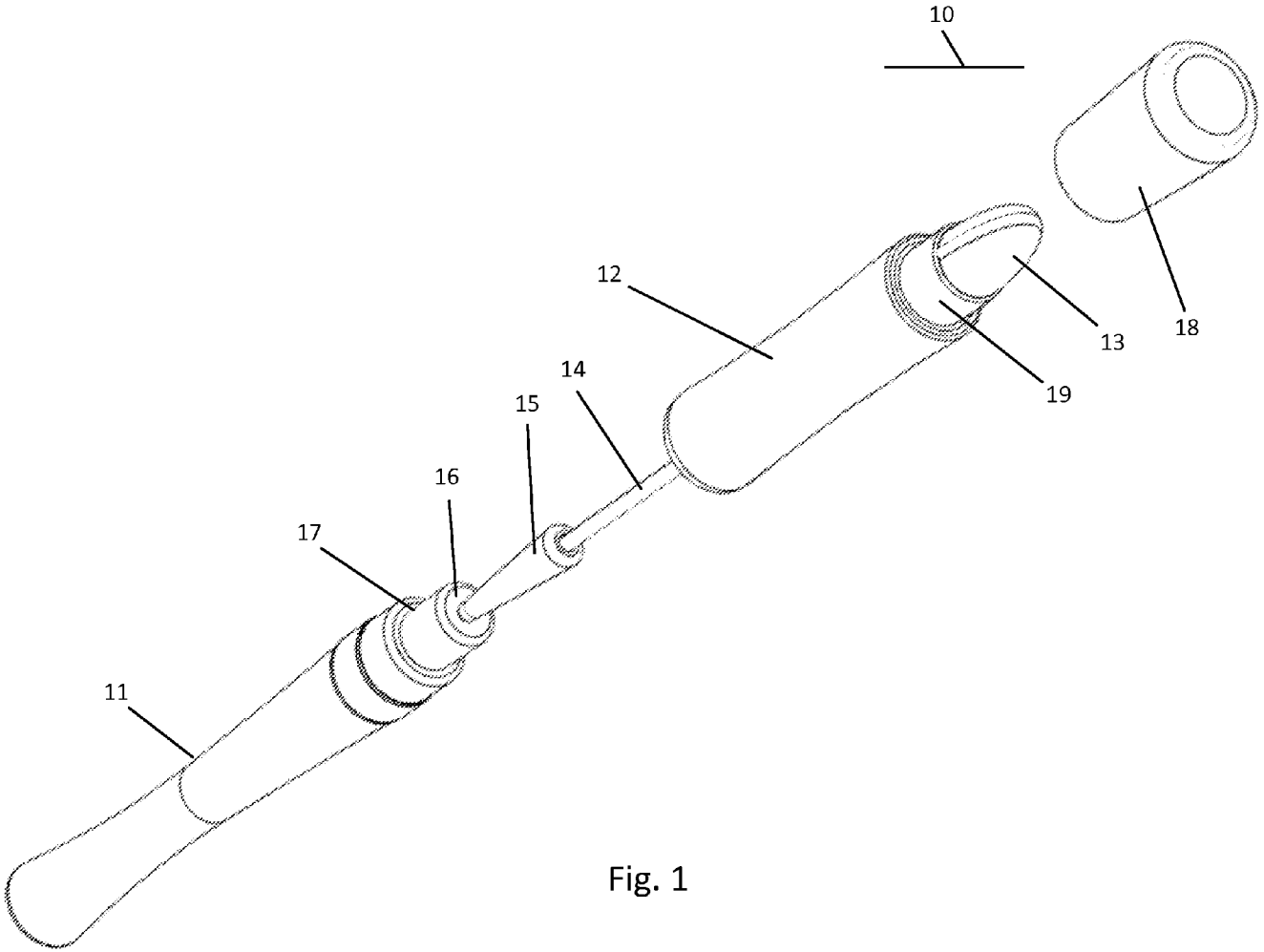
FIG. 1 is a top, front, perspective exploded view of a mascara with ad-hoc user mixable lipstick, concealer, blush, and glitter component according to an exemplary first embodiment of the present invention.
Figure 2A:
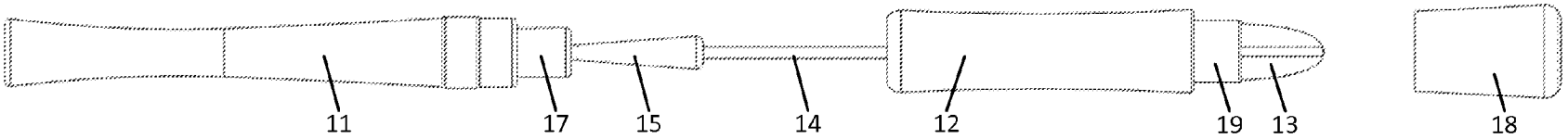
FIG. 2*a* is a side elevation exploded view of a mascara with lipstick, concealer, ad-hoc user mixable blush, and glitter component according to an exemplary first embodiment of the present invention.
Figure 2B:
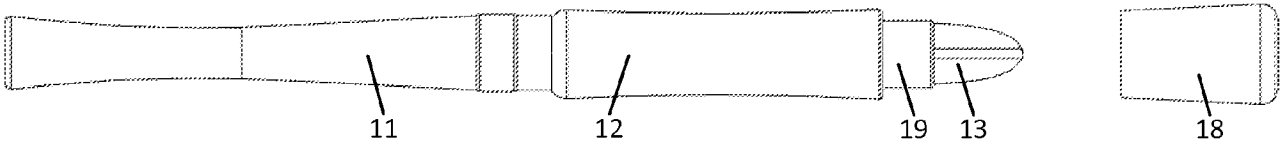
FIG. 2*b* is a side elevation partially exploded view of a mascara with lipstick, concealer, ad-hoc user mixable blush, and glitter component with integral mascara according to an exemplary first embodiment of the present invention.
Figure 2C:
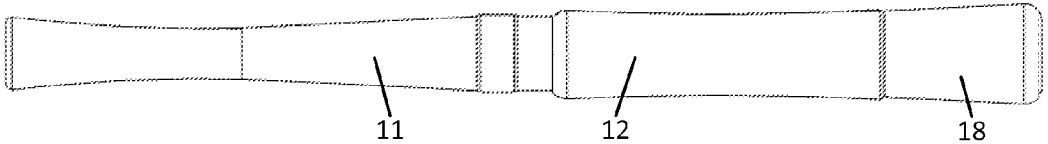
FIG. 2*c* is a side elevation view of a mascara with lipstick, concealer, ad-hoc user mixable blush, and glitter component according to an exemplary first embodiment of the present invention.

Referring now to FIGS. 1, 2, 3, and 4, a mascara with lipstick, concealer, ad-hoc user mixable blush, and glitter component 10 of the present invention is shown and comprised of a generally cylindrical housing disposed along a longitudinal axis with a substantially circular cross section. At one end, the hollow cavity is closed at it distal-most extent and contains mascara (the mascara portion 11). The balance of the cylindrical housing disposed at the other end (the stick portion 12) contains lipstick, concealer, ad-hoc user mixable blush, and glitter component stick (the stick cosmetic) 13. Mascara portion 11 is screwably or slidably affixable to the base of stick portion 12 such that mascara applicator shaft 14 and brush 15 affixed to the base of stick portion 12 protrude longitudinally into the mascara-filled hollow core 16 of mascara portion 11 when the two portions are screwed or slid together. The base of stick portion 12 where mascara applicator shaft 14 is affixed is recessed such that mascara mating sleeve 17 of mascara portion 11 may be slidably affixed with the base of stick portion 12. Alternately, the recess where mascara applicator shaft 14 is affixed to stick portion 12 and mascara mating sleeve 17 of mascara portion 11 may threaded such that stick portion 12 and mascara portion 11 may be threaded together.

Stick portion 12 forms the outer periphery of substantially cylindrical stick cosmetic 13. To prevent stick cosmetic 13 from drying out or attracting dust, mascara with lipstick, concealer, ad-hoc user mixable blush, and glitter component 10 further comprises substantially cylindrical cap 18 closed at one end and configured such that it may be slidably or screwably affixed to stick portion 12 by sliding or screwing cylindrical cap 18 over cap mating sleeve 19 extending concentrically from stick portion 12. Stick cosmetic 13 may be advanced from, or withdrawn into, stick portion 12 in the usual manner.

Figure 3A:
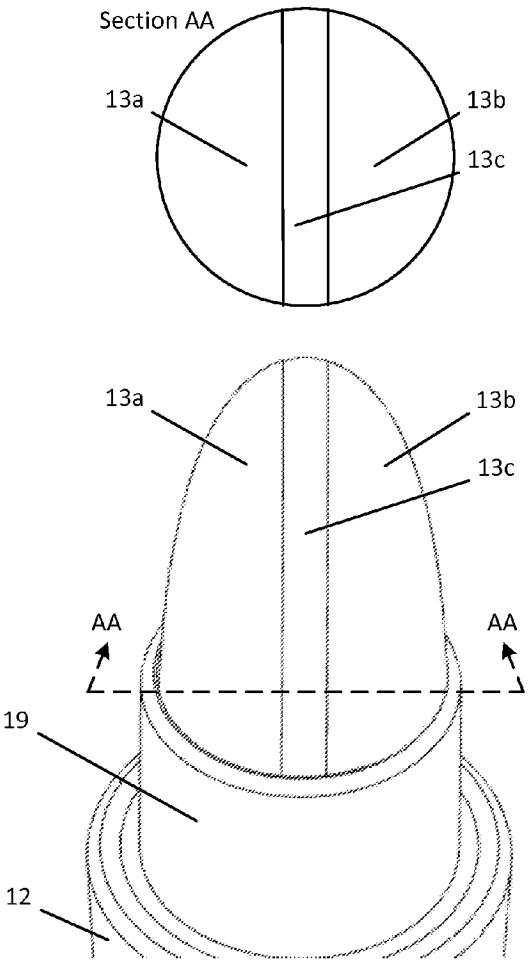
FIG. 3*a* is a top, front perspective view of a mascara with lipstick, concealer, ad-hoc user mixable blush, and glitter component according to an exemplary first embodiment of the present invention detailing a first exemplary embodiment of the lipstick, concealer, ad-hoc user mixable blush, and glitter component stick.
Figure 3B:
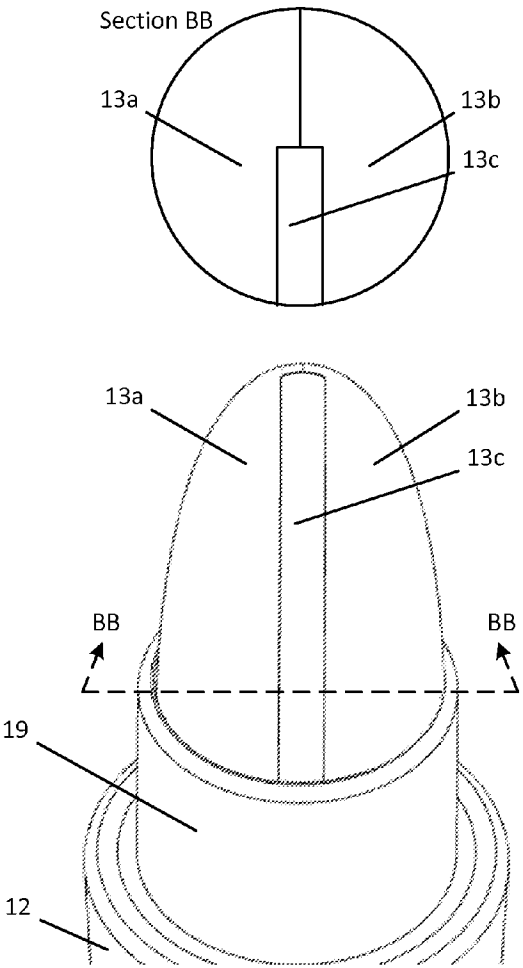
FIG. 3*b* is a top, front perspective view of a mascara with lipstick, concealer, ad-hoc user mixable blush, and glitter component according to an exemplary first embodiment of the present invention detailing a second exemplary embodiment of the lipstick, concealer, ad-hoc user mixable blush, and glitter component stick.

Referring now to FIGS. 1, 3*a* and 3*b*, first and second exemplary embodiments of stick cosmetic 13 comprising first and second exemplary embodiments, respectively, of mascara with lipstick, concealer, ad-hoc user mixable blush, and glitter component 10 are shown. In FIG. 3*a*, the first exemplary embodiment of stick cosmetic 13 is longitudinally sectioned into three adjoined layers: lipstick layer 13*a*, glitter component layer 13*c*, and concealer layer 13*b* such that glitter component layer 13*c* is disposed between the other two. In FIG. 3*b*, the second exemplary embodiment of stick cosmetic 13 is longitudinally sectioned into adjoined lipstick layer 13*a*, glitter component layer 13*c*, and concealer layer 13*b* such that the layer containing glitter component 13*c* is only partially disposed between the other two.

The composition of the lipstick layer 13*a* can be any suitable lipstick composition. Non-limiting examples of such lipstick compositions are notoriously ubiquitous in the prior art. One such suitable one is disclosed in U.S. Pat. No. 4,996,044.

The composition of the concealer layer 13*b* can be any cosmetic concealer composition suitable for forming in a stick. Non-limiting examples of such concealer compositions are also well known in the prior art. One such suitable one is disclosed in U.S. Pat. No. 7,037,511

The composition of glitter component layer 13*c* can be any suitable colored cosmetic substance containing mica or glitter suitable for forming in a stick. Non-limiting examples of such colored cosmetic substances containing mica compositions, for example, are well known in the prior art. One is disclosed, others, in U.S. Pat. No. 4,756,906.

The composition of the mascara filling the closed, distal-most part of mascara portion 11 can be any suitable mascara composition. Non-limiting examples of such mascara compositions are also well known in the prior art. One such suitable one is disclosed in U.S. Pat. No. 5,053,220.

Referring now to FIGS. 1 through 3*a*, the first exemplary embodiment of the invention is used in the following manner: At any time, the user may pull or unscrew mascara portion 11 from stick portion 12 and use newly exposed mascara applicator shaft 14 and brush 15 to apply mascara to the eyelashes in the conventional manner. When done, the user inserts mascara applicator shaft 14 and brush 15 into the mascara-filled hollow core 16 of mascara portion 11 and slidably or screwably affixes mascara portion 11 to the base of stick portion 12. To use stick cosmetic 13, the user removes cylindrical cap 18 from stick portion 12 by pulling or unscrewing, advances stick cosmetic 13 to expose some portion of the three adjoined layers in the usual way and performs at least one of the following actions:

To apply lipstick, the user aligns stick cosmetic 13 such that some point on the longitudinally aligned mid-line of lipstick layer 13*a* on the outer surface of lipstick layer 13*a* is aligned tangentially with respect to the lip and applies lipstick to the lip in the usual manner by stroking lipstick layer 13*a* across the surface of the lip.

To apply concealer, the user aligns stick cosmetic 13 such that some point on the longitudinally aligned mid-line of concealer layer 13*b* is aligned tangentially with respect to the surface of the skin where the concealer is desired and applies concealer to the skin in the usual manner by stroking concealer layer 13*b* across the skin.

To apply blush, the user aligns stick cosmetic 13 such that some point on the longitudinally aligned mid-line of lipstick layer 13*a* is aligned tangentially with respect to the surface of the skin where the blush is desired and applies lipstick to the skin by stroking lipstick layer 13*a* across the skin. The lipstick is then blended into the skin by the user.

To mix and apply lipstick with glitter, the user aligns stick cosmetic 13 such that the longitudinally aligned interface between lipstick layer 13*a* and glitter component layer 13*c* along the outer surface of stick cosmetic 13 is aligned tangentially with respect to the lip and applies both lipstick and glitter component to the lip in the usual manner by stroking the interface between the two layers across the surface of the lip.

To mix and apply concealer with glitter, the user aligns stick cosmetic 13 such that the longitudinally aligned interface between concealer layer 13*b* and glitter component layer 13*c* along the outer surface of stick cosmetic 13 is aligned tangentially with respect to surface of the skin where the concealer with glitter is desired and applies both concealer and glitter component to the skin in the usual manner by stroking the interface between the two layers across the skin.

To mix and apply blush with glitter, the user aligns stick cosmetic 13 such that the longitudinally aligned interface between lipstick layer 13*a* and glitter component layer 13*c* along the outer surface of stick cosmetic 13 is aligned tangentially with respect to surface of the skin where the lipstick and glitter component are desired and applies both the concealer and glitter component to the skin in the usual manner by stroking the interface between the two layers across the skin. The lipstick and glitter component are then blended into the skin by the user.

To mix and apply lipstick, concealer, and glitter as a variable hue lipstick with glitter, the user aligns stick cosmetic 13 such that some point on the longitudinally aligned mid-line between lipstick layer 13*a* and concealer layer 13*b* lying in glitter component layer 13*c* along the outer surface of stick cosmetic 13 is aligned tangentially with respect to the surface of the lip such that the user may apply the lipstick, concealer, and glitter components simultaneously to the lip by stroking all three layers across the lip.

To mix and apply lipstick, concealer, and glitter as a variable hue blush with glitter, the user aligns stick cosmetic 13 such that some point on the longitudinally aligned mid-line between lipstick layer 13*a* and concealer layer 13*b* lying in glitter component layer 13*c* along the outer surface of stick cosmetic 13 is aligned tangentially with respect to surface of the skin where the lipstick, concealer, and glitter components are desired and applies the lipstick, concealer, and glitter components simultaneously to the skin by stroking all three layers across the skin. The lipstick, concealer, and glitter component are then blended into the skin by the user.

Referring now to FIGS. 1 through 2*c* and 3*b*, while variable hue lipstick and blush may be applied using the first exemplary embodiment via a multi-step operation (i.e. apply lipstick, then concealer, then manually blend), a second exemplary embodiment of a mascara with lipstick, concealer, ad-hoc user mixable blush, and glitter component 10 is constructed as described above in the foregoing paragraphs, with the exception that stick cosmetic 13 is longitudinally sectioned into adjoined lipstick layer 13*a*, glitter component layer 13*c*, and concealer layer 13*b* such that glitter component layer 13*c* is only partially disposed between the other two. This has the advantage of providing one side of stick cosmetic 13 where lipstick layer 13*a* and concealer layer 13*b* are directly juxtaposed next to each other along a longitudinally directed interface without glitter component layer 13*c* interposed between. This provides an optimized system for applying variable hue lipstick and blush without glitter. Specifically:

To apply lipstick in a user definable hue, the user aligns stick cosmetic 13 according to this second exemplary embodiment of the present invention such that the longitudinally aligned interface between lipstick layer 13*a* and concealer layer 13*b* along the outer surface of stick cosmetic 13 is aligned tangentially with respect to the lip and applies both lipstick and concealer to the lip by stroking the interface between the two layers across the surface of the lip. By rotating stick cosmetic 13 to vary the surface area of lipstick layer 13*a* with respect to concealer layer 13*b* during application, the user may define numerous new hues of lipstick. Further, when applying a stroke of cosmetic, the user may simultaneously rotate stick cosmetic 13 to lay down a continuously varying range of hues.

To apply blush in a user definable hue, the user aligns stick cosmetic 13 according to this second exemplary embodiment of the present invention such that the longitudinally aligned interface between lipstick layer 13*a* and concealer layer 13*b* along the outer surface of stick cosmetic 13 is aligned tangentially with respect to the skin where a user definable hue of blush is desired and applies both lipstick and concealer to the skin by stroking the interface between the two layers across the surface of the skin. The lipstick and concealer are then blended into the skin by the user. As above, by rotating stick cosmetic 13 to varying the surface area of lipstick layer 13*a* with respect to concealer layer 13*b* during application, the user may define numerous new hues of blush. Further, when applying a stroke of cosmetic, the user may rotate stick cosmetic 13 to lay down a continuously varying range of hues.

Of course, one having skill in the art will readily recognize that other embodiments suitable for the application of lipstick, concealer, a mixture thereof, and/or further comprising admixed glitter component are readily conceivable. For example, referring to FIGS. 1 and 4*a*, stick cosmetic 13 is longitudinally sectioned into adjoined lipstick layer 13*a*, glitter component layer 13*c*, and multiple concealer portions 13*b*' and 13*b*" comprising different shades of concealer. Ordinarily, one of these portions would be relatively light (say custard color) while the other would be dark (say cocoa color) but any combination is conceivable. Similarly, referring to FIGS. 1 and 4*b*, stick cosmetic 13 is longitudinally sectioned into multiple lipstick portions 13*a*' and 13*a*" comprising different shades of lipstick, glitter component layer 13*c*, and concealer layer 13*b*. Similarly, referring to FIGS. 1 and 4*c*, stick cosmetic 13 is longitudinally sectioned into multiple lipstick portions 13*a*' and 13*a*" comprising different shades of lipstick, multiple glitter component portions 13*c*' and 13*c*" comprising different shades of glitter component, and multiple concealer portions 13*b*' and 13*b*" comprising different shades of concealer. Similarly, referring to FIGS. 1 and 4*d*, stick cosmetic 13 is longitudinally sectioned into adjoined lipstick layer 13*a*, glitter component layer 13*c*, and concealer layer 13*b*. In this embodiment, each layer comprises substantially one-third of the mass of stick cosmetic 13.

Figure 4A:
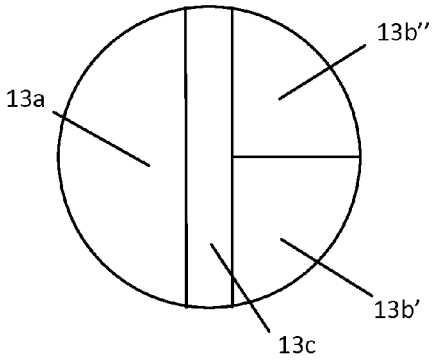
FIG. 4*a* is a cross-section view of the lipstick, concealer, ad-hoc user mixable blush, and glitter component stick according to an exemplary third embodiment of the present invention.
Figure 4B:
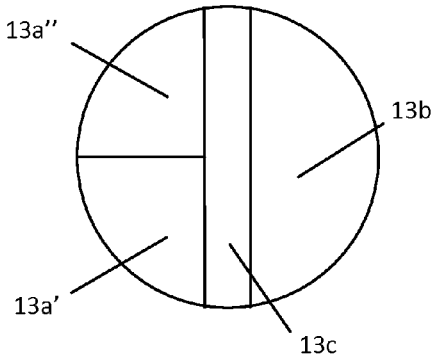
FIG. 4*b* is a cross-section view of the lipstick, concealer, ad-hoc user mixable blush and glitter component stick according to an exemplary fourth embodiment of the present invention.
Figure 4C:
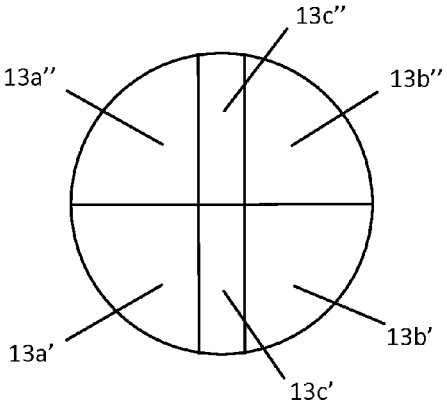
FIG. 4*c* is a cross-section view of the lipstick, concealer, ad-hoc user mixable blush, and glitter component stick according to an exemplary fifth embodiment of the present invention.
Figure 4D:
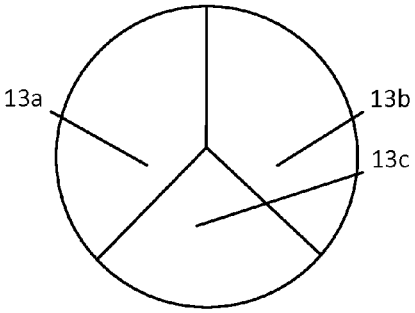
FIG. 4*d* is a cross-section view of the lipstick, concealer, ad-hoc user mixable blush, and glitter component stick according to an exemplary sixth embodiment of the present invention.

The principle advantage of the embodiments disclosed in FIGS. 4*a* through 4*c* is the inclusion of one more variants (usually colors or shades) of at least one of the components. The principle advantage of the embodiment disclosed in FIG. 4*d* concerns increasing the application surface area of glitter component layer 13*c* relative to the other two components such that the ratio of glitter component applied versus the other two may be substantially increased. Further, the embodiment presented in FIG. 4*d* has a second advantage of allowing the user to easily apply only glitter component if desired.

In view of the foregoing paragraphs, while the present invention has been disclosed in what are considered to be the best and most useful embodiments, those having skill in the art will recognize that an almost infinite arrangement of substances, colors, numbers of layers or components and relative surface areas may be combined to comprise cosmetic stick 13 and that all such arrangements and combinations are implicitly included in the spirit and scope of the present invention.

What is claimed is:

1. A mascara with lipstick, concealer, ad-hoc user mixable blush, and glitter component comprising:

a. a stick portion comprising a generally cylindrical housing aligned along a longitudinal axis with a closed end containing a single component stick which includes a lipstick, concealer, ad-hoc user mixable blush, and glitter; said component stick also aligned along a longitudinal axis wherein both longitudinal axes are coaxial and the cross-section of the stick portion defines the periphery of the lipstick, concealer, ad-hoc user mixable blush, and glitter component stick;

b. a mascara applicator shaft with brush aligned along a longitudinal axis affixed to the closed end of the stick portion such that the mascara applicator brush is disposed away from the stick portion and the longitudinal axis of the mascara applicator shaft and brush is coaxial with the longitudinal axis of the stick portion;

c. a mascara portion comprising a generally cylindrical housing aligned along a longitudinal axis with a closed end containing mascara wherein the mascara portion is affixable to the stick portion such that the mascara applicator shaft and brush are disposed inside the mascara portion and the longitudinal axes of the mascara portion, mascara applicator shaft and brush, and the stick portion are coaxial when so affixed;

d. a cap comprising a generally cylindrical housing aligned along a longitudinal axis with a closed end wherein the cap is affixable to the stick portion such that the cap covers the open end of the stick portion and the lipstick, concealer, ad-hoc user mixable blush, and glitter component stick is covered by the cap and the longitudinal axes of the cap and stick portion are coaxial when so affixed.

2. A mascara with lipstick, concealer, ad-hoc user mixable blush, and glitter component of claim 1 wherein the lipstick, concealer, ad-hoc user mixable blush, and glitter component stick is comprised of longitudinally aligned layers of lipstick, concealer, and glitter component such that the layer containing the glitter component is disposed between the other two and extends to the periphery of the lipstick, concealer, ad-hoc user mixable blush, and glitter component stick on two sides.

3. A mascara with lipstick, concealer, ad-hoc user mixable blush, and glitter component of claim 1 wherein the lipstick, concealer, ad-hoc user mixable blush, and glitter component stick is comprised of longitudinally aligned layers of lipstick, concealer, and glitter component such that the layer containing the glitter component is partially disposed between the other two and extends to the periphery of the lipstick, concealer, ad-hoc user mixable blush, and glitter component stick on one side.

4. A mascara with lipstick, concealer, ad-hoc user mixable blush, and glitter component of claim 2 wherein the concealer layer is comprised of two longitudinally aligned portions each containing a different formulation of concealer one formulation of which differs from the other in a least one ingredient.

5. A mascara with lipstick, concealer, ad-hoc user mixable blush, and glitter component of claim 2 wherein the lipstick layer is comprised of two longitudinally aligned portions each containing a different formulation of lipstick one formulation of which differs from the other in a least one ingredient.

6. A mascara with lipstick, concealer, ad-hoc user mixable blush, and glitter component of claim 2 wherein:

a. the concealer layer is comprised of two longitudinally aligned portions each containing a different formulation of concealer one formulation of which differs from the other in a least one ingredient;

b. the lipstick layer is comprised of two longitudinally aligned portions each containing a different formulation of lipstick one formulation of which differs from the other in a least one ingredient; and c. the glitter component layer is comprised of two longitudinally aligned portions each containing a different formulation of glitter component one formulation of which differs from the other in a least one ingredient wherein one portion extends to the periphery of the lipstick, concealer, ad-hoc user mixable blush, and glitter component stick on one side and the other portion extends to the periphery of the lipstick, concealer, ad-hoc user mixable blush, and glitter component stick on the opposite side.

7. A mascara with lipstick, concealer, ad-hoc user mixable blush, and glitter component of claim 1 wherein the lipstick, concealer, ad-hoc user mixable blush, and glitter component stick is comprised of longitudinally aligned portions of lipstick, concealer, and glitter component such that each of the three portions comprise about one-third of the mass of lipstick, concealer, ad-hoc user mixable blush, and glitter component stick, and all three portions extend to the periphery of the lipstick, concealer, ad-hoc user mixable blush, and glitter component stick such that each portion comprises about one third of the periphery.

8. A method of using a mascara with lipstick, concealer, ad-hoc user mixable blush, and glitter component of claim 1 to simultaneously apply lipstick with glitter component to the skin comprising the steps of:

a. aligning the lipstick, concealer, ad-hoc user mixable blush, and glitter component stick such that the longitudinally aligned interface between the lipstick layer and the glitter component layer along the outer surface of the lipstick, concealer, ad-hoc user mixable blush, and glitter component stick is aligned tangentially with respect to the skin;

b. applying lipstick and glitter component simultaneously to the skin by stroking the interface between the two layers across the surface of the skin.

9. A method of using a mascara with lipstick, concealer, ad-hoc user mixable blush, and glitter component of claim 1 to simultaneously apply lipstick, concealer, and glitter component to the skin comprising the steps of:

a. aligning the lipstick, concealer, ad-hoc user mixable blush, and glitter component stick such that some point on the longitudinally aligned mid-line between the lipstick layer and the concealer layer lying in the glitter component layer along the outer surface of lipstick, concealer, ad-hoc user mixable blush, and glitter component stick is aligned tangentially with respect to the skin;

b. applying the lipstick, concealer, and glitter component simultaneously to the skin by stroking all three layers across the skin.

* * * * *